US009234323B2

(12) United States Patent
Gerrard et al.

(10) Patent No.: US 9,234,323 B2
(45) Date of Patent: Jan. 12, 2016

(54) POST FOOTING

(71) Applicants: Robert Gerrard, Coventry (GB); Marcus Gerrard, Coventry (GB)

(72) Inventors: Robert Gerrard, Coventry (GB); Marcus Gerrard, Coventry (GB)

( * ) Notice: Subject to any disclaimer, the term of this patent is extended or adjusted under 35 U.S.C. 154(b) by 0 days.

(21) Appl. No.: 14/378,413

(22) PCT Filed: Jan. 9, 2013

(86) PCT No.: PCT/GB2013/050025
§ 371 (c)(1),
(2) Date: Aug. 13, 2014

(87) PCT Pub. No.: WO2013/136042
PCT Pub. Date: Sep. 19, 2013

(65) Prior Publication Data

US 2015/0016883 A1 Jan. 15, 2015

(30) Foreign Application Priority Data

Mar. 14, 2012 (GB) ..... 1204534.0

(51) Int. Cl.
*E01F 15/00* (2006.01)
*E01F 13/12* (2006.01)

(52) U.S. Cl.
CPC ..... *E01F 15/00* (2013.01); *E01F 13/12* (2013.01)

(58) Field of Classification Search
CPC ..... E01F 15/00; E01F 15/003; E01F 9/011; E01F 9/0117; E01F 13/12; E04H 6/42; E02D 27/42; E02D 27/50
USPC ..... 404/6; 49/49, 33, 133; 52/294, 296
See application file for complete search history.

(56) References Cited

U.S. PATENT DOCUMENTS 6,409,419 B1 * 6/2002 Hernandez ..... E01F 15/003 404/6
2008/0038056 A1 * 2/2008 Patel ..... E01F 15/003 404/6

(Continued)

FOREIGN PATENT DOCUMENTS

DE 7541461 U 8/1976
GB 2487582 A 8/2006

(Continued)

OTHER PUBLICATIONS

International Search Report filed in connection with PCT/GB2013/050025 with a mailing date of Apr. 2, 2013.

(Continued)

*Primary Examiner* — Abigail A Risic
(74) *Attorney, Agent, or Firm* — Levenfeld Pearlstein, LLC

(57) ABSTRACT

This invention presents a security barrier post (10) which has an underground footing (12) and an impact post (14) that extends above the surface. The underground footing (12) has a substantially vertical tubular steel shaft (16) having an opening at its lower end on an impact facing side and a steel foot box (18) aligned with the opening. A bottom plate (20) is provided to which the shaft (16) and said foot (18) box are attached. A spring steel back plate (22) is arranged adjacent and perpendicular to rear facing side of the shaft (16), and extends to at least one side of it. The back plate (22) is located at a position that is flush with or slightly below the surface in which the footing is buried. The impact post (14) has at least a first spring steel element (32) which is L shaped, and at least one packing element (34, 36, 38) located behind the first element (32) to retain it in a position in which it extends into the foot box (18).

20 Claims, 3 Drawing Sheets

(56) References Cited

U.S. PATENT DOCUMENTS

| | | | | |
|---|---|---|---|---|
| 2008/0112756 | A1 | 5/2008 | Omar | |
| 2009/0028638 | A1* | 1/2009 | Crawford | E01F 13/12 404/6 |
| 2009/0035061 | A1* | 2/2009 | Crawford | E01F 9/0116 404/6 |
| 2009/0208285 | A1* | 8/2009 | Adler | E01F 9/011 404/6 |
| 2011/0293366 | A1* | 12/2011 | Gerrard | E01F 15/0476 404/6 |
| 2014/0017003 | A1* | 1/2014 | Ball | E01F 9/0117 404/6 |
| 2015/0225919 | A1* | 8/2015 | Wagler | E02D 27/42 521/166 |

FOREIGN PATENT DOCUMENTS

| | | | |
|---|---|---|---|
| GB | 2467411 | A | 8/2010 |
| WO | 9002860 | A1 | 3/1990 |

OTHER PUBLICATIONS

British Search Report filed in connection with GB1204534.0 with a mailing date of Jul. 20, 2012.

* cited by examiner

POST FOOTING

This is a National Stage Application of International Patent Application No. PCT/GB2013/050025, flied Jan. 9, 2013, which claims the benefit of and priority to Great Britain (GB) Patent Application No. 1204534.0, filed Mar. 14, 2012, the entirety of which are incorporated fully herein by reference.

This invention relates to security barriers and posts for security barrier, in particular to shallow underground post footings for security barrier posts.

Security barriers, or crash barriers, the main purpose of which being to prevent the passage of vehicles, are widely known in the art and have many applications. Common applications are for bordering dangerous sections of roads, providing a central separation between lanes of traffic moving in opposite directions and around secure areas, for example around the entrance to airports or the like.

Known security barriers are generally made of metals, in particular steel, and comprise a post, which is bedded in concrete, to which a barrier is attached. To provide the structural integrity to stop a car moving at around 40 to 50 km/h such barriers need a very deep reinforced bedding of around a meter in depth and, for larger trucks a bedding of up to two meters, into which the posts are set, is needed. As well as the obvious disadvantages in terms of the amount of material needed and the increased complexity of excavating to the required depth, the necessity of burying the posts to such a depth often interferes with existing buried services, for example electricity cables and sewage or water pipes. Although many are marked and can be anticipated during the planning stage, the discovery of pipes during deep excavation is common and necessitates halting excavation until the nature of the pipe/cable has been ascertained.

Furthermore, even when bedded deeply into concrete, the loads exerted on the concrete by the post, as it is struck, can cause damage to the concrete bed reducing the strength of the barrier against future impacts unless re-worked.

As security measures are heightened in response to such threats as terrorism at airports it is increasingly important to prevent "punch through" by vehicles, that is to have barriers that prevent a first vehicle breaking the structural integrity of a barrier such that a second vehicle, following the first vehicle, can pass through the barrier by pushing the first vehicle out of the way. As such the permanent deformation of existing barrier posts or damage to the concrete in which they are bedded is highly undesirable.

As a result of increased security threats additional security barriers are being introduced in many new places, the excavation of the footings for which is highly disruptive. Some known shallow footing security barriers do exist but these all require a string of posts attached together, often to a large underground steel plate, so that the load of impact is spreads through the posts.

WO/2010/086581 discloses a new shallow footing that only requires a 400 mm deep underground profile in order to meet stringent the stringent PAS 68:2010 requirements. However in some situations even 400 mm is to deep a footing to be useful. A particular application where even a 400 mm deep footing is problematic is where it is required to place a security barrier on a bridge. In many instances, particularly when retrofitting security posts to old bridges, the bridge structure will not allow for such a deep footing.

There is therefore a need for a security post having shallower footing than is currently available that can be installed as a stand alone post, i.e. it does not need to be one of a plurality of interlinked posts.

The present invention attempts to mitigate at least some of the above mentioned problems by providing an improved crash barrier with facilitated installation.

According to a first aspect of the invention there is provided a security barrier post comprising an underground footing and an impact post that extends above the surface wherein: said underground footing comprises: a substantially vertical tubular steel shaft having an opening at its lower end on an impact facing side thereof; a steel foot box aligned with said opening; a bottom plate to which said shaft and said foot box are attached; a spring steel back plate arranged immediately adjacent to, substantially perpendicular to, and extending to at least one side of, the rear facing side of the shaft away from which an impact will occur, said back plate located at a position that, in use, is flush with or slightly below a surface in which the footing is buried; and wherein said impact post comprises at least a first spring steel element comprising a substantially vertical section and a substantially horizontal section, and at least one packing element located behind said first spring steel element to retain it in a position in which said horizontal section extends into said foot box.

The underground footing may further comprise a spring steel foot plate arranged substantially perpendicular to, and extending to at least one side of, the lower end of the shaft at a position spaced from the back plate;

The first vertical spring steel element is located at the impact facing side of the post and said packing element may comprise a plurality of substantially vertical spring steel elements at least some of which are configured to extend from said footing above ground level. Alternatively, or in addition said packing element may comprise a piece of steel that does not substantially extend above ground level.

The design of the post enables far shallower footings to be used than was previously believed possible without loosing structural integrity; in particular it enables relatively light weight stand alone posts with shallow footings to effectively stop heavy vehicles travelling at speed.

Furthermore, the design enables the post footing to be installed before the posts are fitted, i.e. in use the post footing is set in the ground in a concrete foundation and then the post can be fitted to the installed footing. This makes the footing exceptionally easy to handle and install without the post being attached and the compact design obviates the need to use a crane to lift it into position. The design presented herein is the only design available that meets PAS 68 2010 that enables the footing and post to be installed separately.

The shallow post of the invention reduces the need to divert underground utilities and is small and easy to install. As the system provides stand alone posts they can easily follow the contours of the ground or be arranged to go around corners.

Preferably the first vertical spring steel element is at the impact facing side of the post and a plurality of substantially vertical spring steel elements are located in said tubular steel shaft behind said first vertical spring steel element so as to maintain said first vertical spring steel element in a position in which the horizontal section thereof extends into said foot box. The tubular shaft is preferably rectangular in section although as any spaces not filled by the vertical elements can be filled with grout as described below other non rectangular shapes could be used.

Preferably the depth of said footing is a maximum of 250 mm, more preferably the depth of said footing is a maximum of 200 mm.

The relative size of the cross section of the tubular steel shaft and the substantially horizontal section are such that the first vertical spring steel element can be inserted into the tubular steel shaft and positioned such that its substantially horizontal section extends into the foot box. This enables the first vertical spring steel element to be inserted into and removed from the shaft in the absence of the other spring steel elements.

The plurality of substantially vertical spring steel elements may be freely arranged relative one another such that adjacent surfaces thereof may slide over one another as the elements bend under impact. This increases their strength when working together and prevents localised areas of stress at any attachment points.

The plurality of substantially vertical spring steel elements are preferably removable from said footing. In this way, if the elements get damaged after an attack they can be removed from the tubular shaft and replaced without the need to remove the footing from the ground.

The footing preferably further comprises a substantially vertical support plate attached to, and substantially perpendicular to, the tubular steel shaft and the bottom plate.

The tubular steel shaft and the foot box may be welded to the bottom plate.

In a preferred arrangement the spring steel foot plate is arranged above and adjacent to the top surface of the foot box. In use, when assembled the foot of the first spring steel element passes under the concrete foundation and into the foot box, and the foot plate extends over the top of the foot box. When struck by a vehicle it is possible for the vehicle to wrap around the post trapping it. The forward momentum then tries to pull the post from the ground. In the present design the foot of the first element is under the concrete bed and the foot plate extends above it. When struck the foot locks into the concrete bed via the foot box and the load trying to pull it from the ground is distributed into the concrete bed by the foot plate 24 which distributes the load and prevents the post being ripped from the footing. As spring steel is used for the foot plate the loads transferred into it are even distributed along its length reducing stress points that would occur if regular steel was used.

Preferably the security barrier post further comprises: a concrete bed in which said underground footing is received, said concrete bed including steel reinforcement embedded therein, said reinforcement comprising a plurality of cross members parallel to the front-back axis of the post and a plurality of longitudinal members substantially perpendicular to said cross members, at least some of said cross members behind and substantially abutting the back plate. Preferably at least some of said cross members are in front of and substantially abutting the back plate. The concrete bed may be substantially 200 mm deep; the concrete bed may be substantially 1200 mm wide; and/or the concrete bed may be substantially 900 mm from front to back. The cross members are substantially rectangular.

According to a second aspect of the invention there is provided a method of constructing a security barrier post, the method comprising the steps of: excavating a shallow trench, locating at least one barrier post footing comprising: a substantially vertical tubular steel shaft having a front opening at its lower end; a steel foot box aligned with said front opening; a bottom plate to which to which said shaft and said foot box are attached; a spring steel back plate arranged immediately adjacent to, substantially perpendicular to, and extending to at least one side of, the rear facing side of the shaft away from which an impact will occur, said back plate located at a position that, in use, is flush with or slightly below a surface in which the footing is buried; within the trench such that the footing of the post is at least partially within said trench; inserting plurality of steel reinforcement cross members parallel to the front-back axis of the post and a plurality of steel reinforcement longitudinal members substantially perpendicular to said cross members in the trench such that at least some of said cross members are behind and substantially abut the back plate; filling the trench with concrete to form a concrete bed such that the back plate of the footing is located at a position that is flush with or slightly below a surface of said concrete; inserting the first vertical spring steel element of the impact post into said tubular shaft and placing it such its horizontal section extends into said foot box; and inserting a packing element in said tubular shaft behind said first vertical spring steel element so as to retain it in place.

Preferably, in the method, inserting a packing element comprises inserting one of: at least one further spring steel element of the impact post, and a packing element comprising a piece of steel that does not substantially extend above ground level, in said tubular shaft.

The concrete bed may be substantially 200 mm deep.

Preferably inserting plurality of steel reinforcement cross members parallel to the front-back axis of the post further comprises inserting said reinforcement such that at least some of said cross members are in front of and substantially abut the back plate.

Preferably the method further comprises filling any gaps in said tubular shaft around said plurality of substantially vertical spring steel elements with grout.

The invention will now be described, by way of example only, with reference to the following figures in which.

Figure 1:
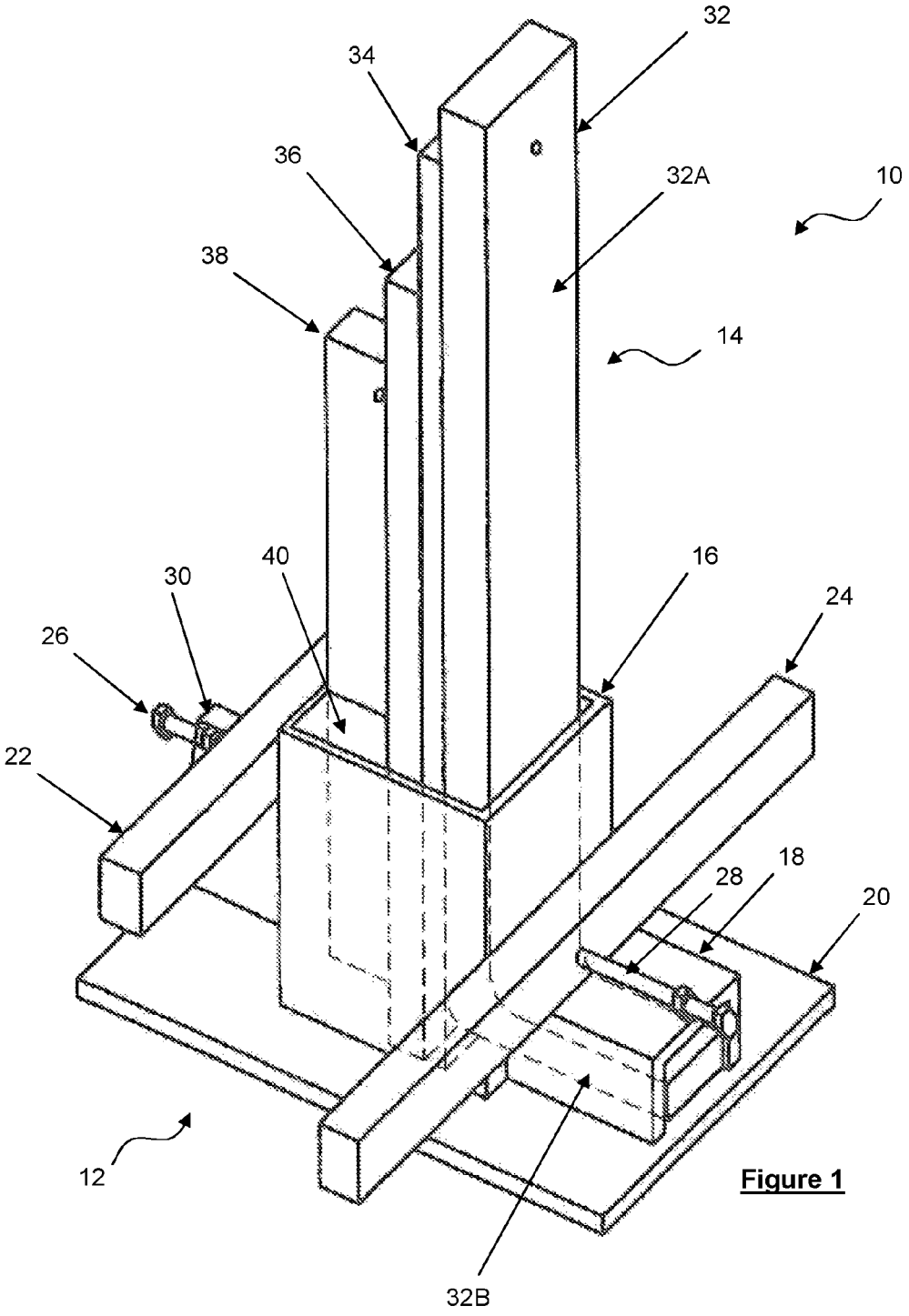
FIG. 1 shows a perspective view of a post of the invention.
Figure 2:
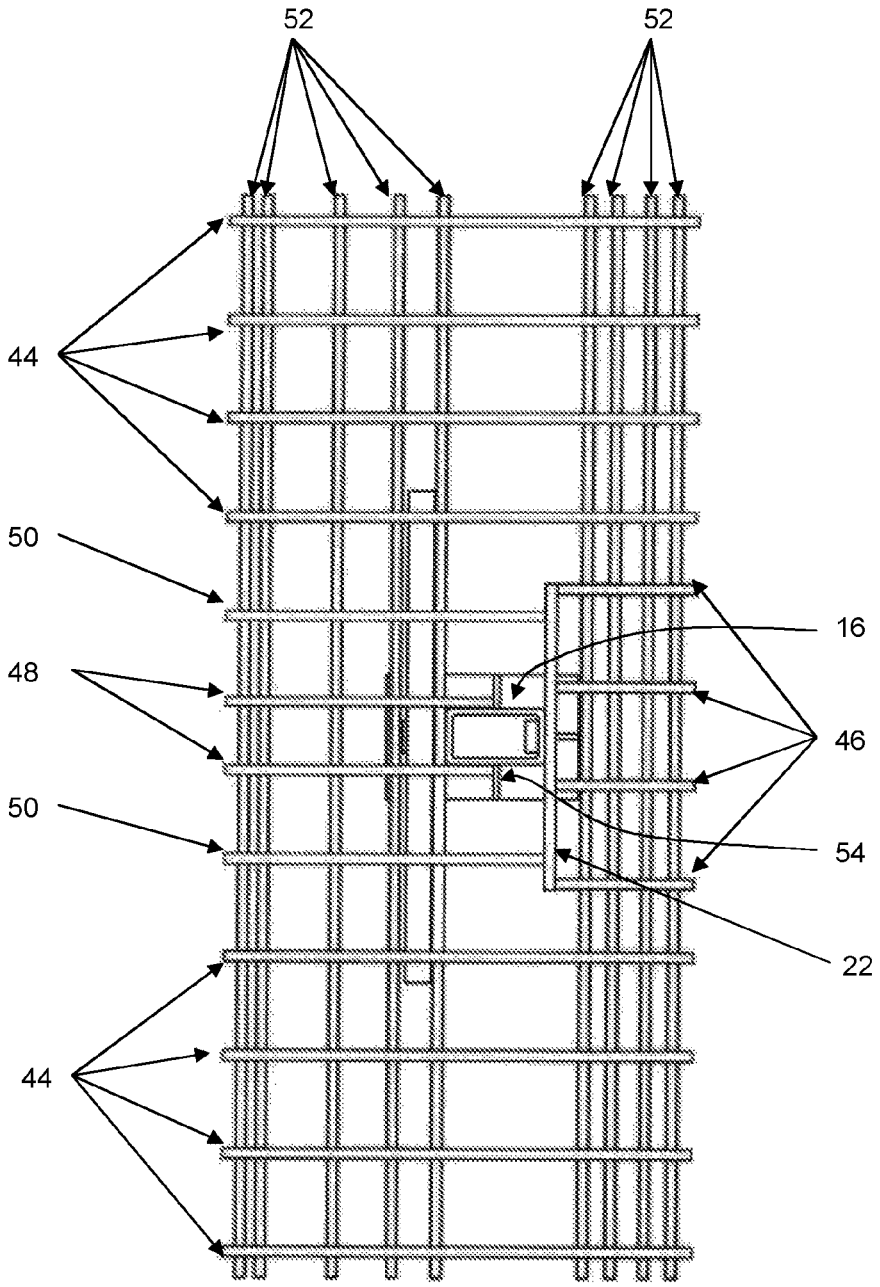
FIG. 2 shows a top view of the footing together with the steel reinforcement of its concrete bedding.
Figure 3:
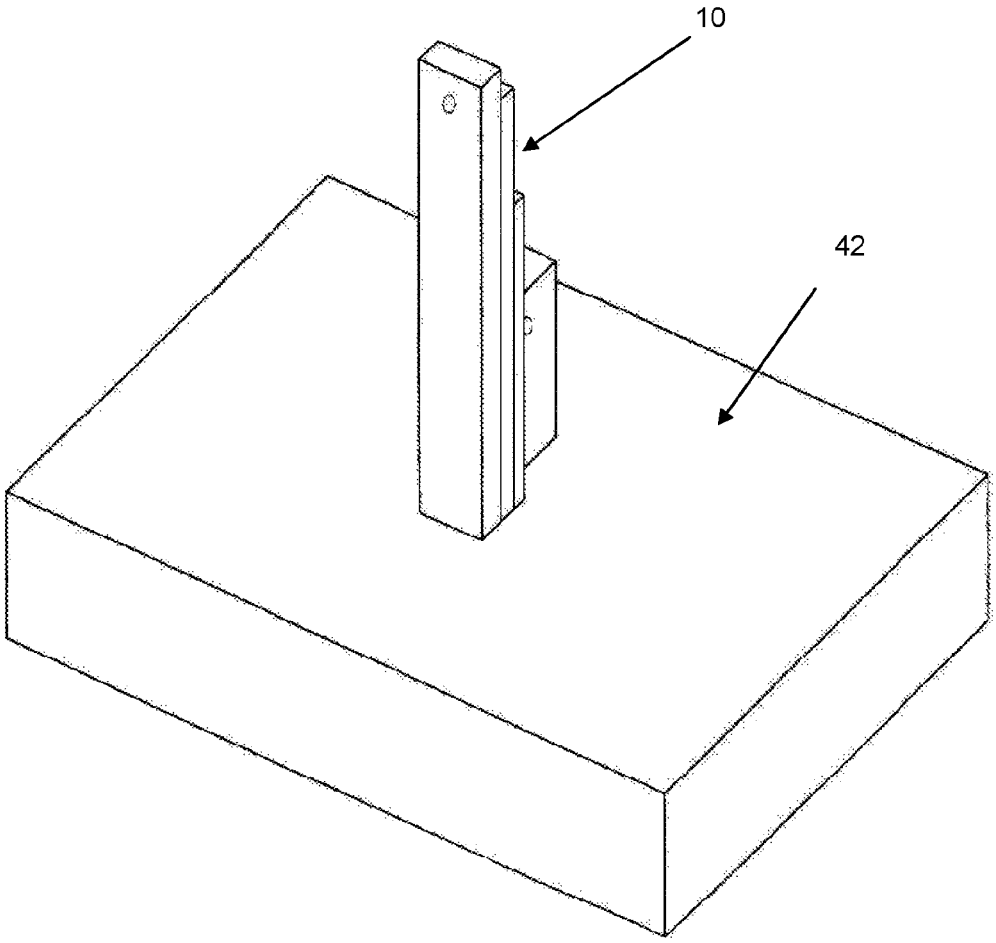
FIG. 3 shows the post together with its foundation.

Referring to FIGS. 1 to 3 a security barrier post 10 is shown. The post 10 has a footing generally denoted as 12, which when installed is substantially underground, and an impact post generally denoted 14 which, when installed, is retained in the footing and extends above the ground level. The impact post 14 has an impact facing side and when installed is orientated with the impact facing side facing towards the direction in which the post is designed to withstand an impact.

The footing 12 is constructed as follows. A substantially vertical tubular shaft 16 is provided which is constructed from tubular steel box section. An opening is provided on the impact facing side of the shaft 16 at its lower end and a foot box 18 also made of steel is arranged adjacent the tubular shaft 16. The second piece of steel 18 may be either box section or square U-channel and is positioned such that an open end thereof aligns with the opening in the shaft 16. Preferably the shaft 16 and second piece of steel 18 are made of regular steel but may optionally be made of a spring steel.

The tubular shaft 16 and foot box 18 are attached at their lower edges to a steel base plate 20. Although it will be appreciated that the plate may be of any suitable size, a plate of 350×500 mm weighing only 58 kg was used in the test sample. The shaft 16 and foot box 18 are welded to the base plate 20 to form a boot like arrangement as shown.

Attached to this boot are two energy absorbing components both of which are constructed from spring steel. One of the energy absorbing components is a back plate 22 that is attached to the rear side of the boot, away from the impact facing side. The back plate 22 is attached to the footing 12 at a position that, in use, is flush with or slightly below a surface in which the footing is buried. Providing that the back plate 22 is immediately adjacent and in contact with the rear side of the shaft 16 it is not necessary for it to be permanently attached as, when installed, it will be retained in place by the concrete bed in which the footing 12 is placed. However, practically it is beneficial to attach the back plate 22 to the shaft 16 to ensure that during installation it remains in the required position as the concrete is poured and sets. It may be attached by means of a threaded bolt 26.

The other energy absorbing component is a spring steel foot plate 24 that is located immediately adjacent the impact facing side of the shaft 12 towards its lower end. The preferred position for the foot plate 24 is adjacent the shaft 12 immediately above the foot box 18. The foot plate 24 is substantially perpendicular to, and extends to either side of shaft 16.

As with the back plate 22 the foot plate 24 may be attached to the shaft 16 by means of a bolt 28.

Optionally an additional support plate 30 may be provided that is attached along two edges, to the base plate 20 and the rear face of the shaft 16 such that it projects from the rear of the shaft 16 substantially perpendicular to its longitudinal axis and perpendicular to the base plate 20. This support plate 30 assists in both providing support to the shaft 16 under impact and in transmitting force from the post, when it is struck, to the base plate 20.

Referring now to the impact post 14, when installed the impact post 14 of the security barrier post 10 is located in the footing 12 so that it is partially below ground level and extends vertically upwards from the footing to create a security post that can withstand an impact form a vehicle travelling at speed and prevent passage of that vehicle.

The impact post 14 comprises a plurality of substantially vertical spring steel elements 32, 34, 36, 38 the lower ends of which are received in the interior of the shaft 16 and are aligned between the impact facing side of the shaft and the rear facing side of the shaft 16. At least one of the vertical spring steel elements 32 has a is L shaped such that it comprises a substantially vertical section 32A and, at its lower end, a substantially horizontal section 32B. It will be appreciated that the element 32 need not strictly be L-shaped as its upper end may be provided with additional features, the important design parameter being the horizontal lower section 32B that forms a foot of the element. When assembled the element 32 is positioned such that the horizontal section extends into the foot box 18 and the remainder of the vertical elements 34, 36, 38 are located behind the element 32 and retain it in position with its horizontal section 32B in the foot box 18.

The horizontal section 32B is of a size that enables it, in the absence of the other elements 34, 36, 38, to be inserted into and removed from the footing. Preferably this is achieved by virtue of the length of the horizontal section being slightly less than the interior dimension of the hollow shaft 16 along its front-back axis. This enables the element 32 to be dropped into the shaft 16 with its vertical section 32A adjacent the interior of the back edge of the shaft 16 until the horizontal section 32A abuts the base plate 20, and then slid towards the impact facing side of the shaft 16 until it abuts that surface and so that the horizontal section 32B passes into the foot box 18. Once the vertical element 32 is in place the remainder of the elements 34, 36, 38 can be slid into the shaft behind the element 32 so as to retain it in its place. When being installed in the ground, once the elements are all in situ a grout may be mixed and filled into any gaps 40 between the elements and the shaft.

The elements 32, 34, 36, 38 are retained in the shaft 16 at their lower end but are not attached to one another at their upper ends. This enables them, under impact, to flex such that their adjacent surfaces can slide over one another. In this way the elements reinforce one another but do so in a manner that enables them to flex without imparting the stresses into the structure that would occur if they were physically attached to one another at their upper ends.

If it is required to remove the elements 32, 34, 36, 38 once the post is installed then holes can be drilled down into the grout 40 to weaken it, and after striking the top of the elements with a hammer to loosen the grout not drilled out the elements can be removed in the reverse order to that in which they were put in. In this way the elements 32, 34, 36, 38 can be replaced if necessary.

The post 10 is, in use, set in a concrete bed 42 so as to firmly anchor it in the ground. The concrete bed is preferably 1200 mm across, 900 mm front to back and extends 200 mm deep into the ground. Although other sizes could be used it these dimensions have been found to form a suitable bed for a post to meet certain test criteria as described below.

The concrete bed is reinforced with steel reinforcement, commonly known as rebar. Preferably a plurality of rebar pieces are arranged around the post within the concrete bed and a preferred arrangement is shown in FIG. 2. The rebar reinforcement comprises a number of different sized pieces of rebar which are shaped into rectangles with radiused corners. To either side of the post at a 100 mm spacing are a number of pieces of steel reinforcement 44 which are 900 mm long by 182 mm high. Located behind the post in a position such that one of their ends is adjacent the back plate 22 are four smaller pieces of steel reinforcement 46, each of which is 180 mm long by 182 mm deep, also spaced at 100 mm from one another. The two outermost of these pieces 46 are substantially at the end of the back plate 22 as depicted.

Two rectangular rebar pieces 48, sized 650 mm long by 182 mm high are positioned to either side of the shaft 16 and extend towards the front on the concrete bed 42. Spaced 100 mm from each of these are two further pieces of reinforcing steel 50 that extend from the front side of the back plate 22 towards the front of the concrete bed. These pieces are preferably 550 mm long by 182 mm wide.

Extending across the entire width of the concrete bed behind the post are four pieces of rebar 52 bent at 90 degrees at either end to form reinforcement 1200 mm long by 150 mm deep. Five similar pieces 52 extend along the width of the concrete bed 42 at the front side of the bed.

A post to the design herein in the bed described was tested at the MIRA (Motor Industry Research Association) in the UK to BSI PAS68 2010. The post was tested by aiming a 7500 kg tuck at 48 and at 64 kilometers per hour (30 and 40 miles per hour) at the post at an angle of 90 degrees, i.e. head on. A single post in the concrete bed described above prevented passage of the vehicle and limited vehicular penetration of the barrier to 2.8 m thereby passing the PAS68 2010 requirements. This is the first time to the inventors knowledge that such a pass has been achieved by a stand alone post in a footing of only 200 mm.

Optional side plates 54 (shown in FIG. 2 only) may be provided extending between the side of the shaft 16 and the base plate 20. Such plates will be arranged in a similar manner as the plate 30 but to either side of the shaft 16. Under impact these plates will help prevent any rotation of the footing in the concrete bed. As shown the rebar rectangles 48 may abut these side plates 54.

It will be recognised by the skilled person that various modifications to the post and method described herein may be made without deviating from the scope of the invention as defined by the claims.

The invention claimed is:

1. A security barrier post comprising an underground footing and an impact post that extends above the surface wherein:

said underground footing comprises:

a substantially vertical tubular steel shaft having an opening at its lower end on an impact facing side thereof;

a steel foot box aligned with said opening;

a bottom plate to which said shaft and said foot box are attached; and a spring steel back plate arranged immediately adjacent to, substantially perpendicular to, and extending to at least one side of, the rear facing side of the shaft away from which an impact will occur, said back plate located at a position that, in use, is flush with or slightly below a surface in which the footing is buried, wherein said impact post comprises at least a first spring steel element comprising a substantially vertical section and a substantially horizontal section, and at least one packing element located behind said first spring steel element to retain it in a position in which said horizontal section extends into said foot box.

2. The security barrier post according to claim 1 wherein the underground footing further comprises a spring steel foot plate arranged substantially perpendicular to, and extending to at least one side of, the lower end of the shaft at a position spaced from the back plate.

3. The security barrier post according to claim 1 wherein said first vertical spring steel element is at the impact facing side of the post and said packing element comprises a plurality of substantially vertical spring steel elements at least some of which are configured to extend from said footing above ground level.

4. The security barrier post according to claim 1 wherein said first vertical spring steel element is at the impact facing side of the post and said packing element comprises a piece of steel that does not substantially extend above ground level.

5. The security barrier post according to claim 1 wherein said tubular shaft is rectangular in section.

6. The security barrier post according to claim 1 wherein the depth of said footing is a maximum of 250 mm.

7. The security barrier post according to claim 1 wherein the depth of said footing is a maximum of 200 mm.

8. The security barrier post according to claim 1 wherein the relative size of the cross section of the tubular steel shaft and the substantially horizontal section are such that the first vertical spring steel element can be inserted into the tubular steel shaft and positioned such that its substantially horizontal section extends into the foot box.

9. The security barrier post according to claim 1 wherein the plurality of substantially vertical spring steel elements are freely arranged relative one another such that adjacent surfaces thereof may slide over one another as the elements bend under impact.

10. The security barrier post according to claim 3 wherein said plurality of substantially vertical spring steel elements are removable from said footing.

11. The security barrier post according to claim 1 wherein said footing further comprises a substantially vertical support plate attached to, and substantially perpendicular to, the tubular steel shaft and the bottom plate.

12. The security barrier post according to claim 1 wherein the tubular steel shaft and the foot box are welded to the bottom plate.

13. The security barrier post according to claim 1 wherein the spring steel foot plate is arranged above and adjacent to the top surface of the foot box.

14. The security barrier post according to claim 1, said security barrier post further comprising:

a concrete bed in which said underground footing is received, said concrete bed including steel reinforcement embedded therein, said reinforcement comprising a plurality of cross members parallel to the front-back axis of the post and a plurality of longitudinal members substantially perpendicular to said cross members, at least some of said cross members behind and substantially abutting the back plate.

15. The security barrier post according to claim 14 wherein at least some of said cross members are in front of and substantially abutting the back plate.

16. The security barrier post according to claim 14 wherein the concrete bed is substantially 200 mm deep.

17. A method of constructing a security barrier post of claim 14, the method comprising the steps of:

excavating a shallow trench, locating at least one barrier post footing comprising: a substantially vertical tubular steel shaft having a front opening at its lower end; a steel foot box aligned with said front opening; a bottom plate to which to which said shaft and said foot box are attached; a spring steel back plate arranged immediately adjacent to, substantially perpendicular to, and extending to at least one side of, the rear facing side of the shaft away from which an impact will occur, said back plate located at a position that, in use, is flush with or slightly below a surface in which the footing is buried; within the trench such that the footing of the post is at least partially within said trench;

inserting a plurality of steel reinforcement cross members parallel to the front-back axis of the post and a plurality of steel reinforcement longitudinal members substantially perpendicular to said cross members in the trench such that at least some of said cross members are behind and substantially abut the back plate;

filling the trench with concrete to form a concrete bed such that the back plate of the footing is located at a position that is flush with or slightly below a surface of said concrete;

inserting the first vertical spring steel element of the impact post into said tubular shaft and placing it such its horizontal section extends into said foot box;

and inserting a packing element in said tubular shaft behind said first vertical spring steel element so as to retain it in place.

18. The method according to claim 17 wherein inserting a packing element comprises inserting one of: at least one further spring steel element of the impact post, and a packing element comprising a piece of steel that does not substantially extend above ground level, in said tubular shaft.

19. The method according to claim 17 wherein inserting the plurality of steel reinforcement cross members parallel to the front-back axis of the post further comprises inserting said reinforcement such that at least some of said cross members are in front of and substantially abut the back plate.

20. The method according to claim 17 wherein said concrete bed is substantially 200 mm deep.

* * * * *